US006851594B1

(12) United States Patent
Huang

(10) Patent No.: US 6,851,594 B1
(45) Date of Patent: Feb. 8, 2005

(54) POSITIONING STAPLE CASE OF STACKER

(76) Inventor: Siu-Tsai Huang, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/686,613

(22) Filed: Oct. 17, 2003

(51) Int. Cl.[7] ..... B25C 1/04
(52) U.S. Cl. ..... 227/109; 227/120
(58) Field of Search ..... 227/109, 119, 227/120, 136

(56) References Cited

U.S. PATENT DOCUMENTS 4,749,115 A * 6/1988 Fehrs ..... 227/109
4,815,647 A * 3/1989 Chou ..... 227/109
5,522,533 A * 6/1996 Mukoyama et al. ..... 227/109
5,873,509 A * 2/1999 Liao ..... 227/109
5,934,539 A * 8/1999 Lee ..... 227/109
6,161,746 A * 12/2000 Wey ..... 227/109
6,564,985 B1 * 5/2003 Chou ..... 227/109
6,644,530 B2 * 11/2003 Chen ..... 227/109
6,715,657 B2 * 4/2004 Chen ..... 227/120

* cited by examiner

*Primary Examiner*—Scott A. Smith

(57) ABSTRACT

A positioning staple case of a stacker includes a gun air-firing mechanism at one end thereof. The staple case is consisted of left and right staple cases. The invention is characterized that, the left staple case has a plurality of pressing strip and a lower side rod disposed on an inner lower side of the left staple case. Using the aforesaid structure, staples having different depths are rested on an upper portion of the lower side rod, and an upper portion of the staples is pressed against a lower portion of a specific pressing strip having a suitable depth for the staples, with the pressing strips located at a highermost position being pushed into the channels using the staples, thereby pressing against staples having different depths in a steady manner.

5 Claims, 6 Drawing Sheets

POSITIONING STAPLE CASE OF STACKER

BACKGROUND OF THE INVENTION (a) Field of the Invention

The invention relates to a positioning staple case of a stacker, and more particularly, to a positioning staple case of a stacker and having pressing strips pushed against by small springs, such that the pressing strips are horizontally displaced by pushing forces from the springs to lean against staples having various specifications using the pressing strips at various heights, thereby pressing the staples having different depths in a steady manner.

(b) Description of the Prior Art

During upholstery carpentry, an air stacker is generally used, so as to eliminate complications and inconveniences of manual stapling as well as to speed up a work process required.

However, boards that need to be assembled are assembled with various heights, and therefore staples needed also come in different depths. To place staples with different depths, a longitudinal recess having a staple case adjustment mechanism capable of adjusting pressing depths is provided. Using the staple case adjustment mechanism pressing against a row of staples, the staples are steadily pushed forward by means of a staple-pushing mechanism.

Yet, common staples exist in certain specifications only. Supposed a non-segmented method is adopted for pressing against the staples, it is necessary that adjustment be made each time a new row of staples is filled. Hassles are resulted whenever the staples are filled and thus causing inconveniences of users.

Referring to the Taiwan Patent Publication No. 424653 disclosing "Stacker Staple Gate", the stacker staple gate comprises a right staple gate and a left staple gate. Wherein, the right staple gate has a stopping plate at a front end thereof and fastened using a sealing board, such that between the sealing board, the right staple gate and the stopping plate is a staple case. The right staple gate has a plurality of longitudinally penetrated sliding grooves, and an elastic pressing plate extended at a lower portion thereof. The left staple gate has a plurality of staggered spring-containing apertures penetrated through the left staple case and corresponding with the sliding grooves of the right staple gate. Each spring-containing aperture is disposed with an accommodating chamber penetrated through the left staple case, and is accommodated with a spring. Each spring has a top end thereof embedded into an upper pin, wherein a main upper pin of an adjacent groove is provided with a side aperture. The side aperture is for inserting with an L-shaped staple-pushing board having a wedge plane. An end face of an upper pin has an accommodating opening for inlaying an extension plate of the stopping plate. The stopping plate is placed in the accommodating chamber and is displaced upward by sliding movements using pushing forces of the spring. The extension plate of the stopping plate is formed as a retaining plane. The left staple gate has an aperture near an upper end thereof. The aperture is for retaining an L-shaped retaining staple-pushing board and a wedge plate of the staple-pushing plane to further prevent slipping off. A lower portion of the left staple gate is fixed with a sealing plate for sealing the lower portion of the left staple gate. The left staple gate is slid into the right staple gate, and is elastically embedded by the elastic pressing plate.

However, the individual pressing plates are independently pushed by the longitudinal springs, and perform back-and-forth sliding movements along the accommodating chambers of the left staple gate. Supposed staples having a smallest depth are placed, the staples are only pushed by one pressing plate. Or, if staples having a largest depth are placed, the staples are pushed by four pressing plates (as a quantity shown in the diagram). Therefore, the staples receive various pushing forces when staples having different depths are placed. When pushing forces received by the staples are unequal, pushing forces for pushing and cutting off the staples required by the staple-pushing mechanism are also different. That is to say, shearing forces from largest pushing forces for cutting off the staples having a largest depth are much too large for the staples having a smallest depth. Vice versa, shearing forces for cutting off staples having a smallest depth is insufficient for cutting off staples having a largest depth. Hence, the prior invention is hardly considered adequate when put to use, and can be further advanced.

SUMMARY OF THE INVENTION

In the view of the aforesaid shortcomings of the prior stackers having fixed positioning depth, the object of the invention is to provide a positioning staple case of a stacker. The staple case according to the invention has a gun air-firing mechanism at one side thereof, and is consisted of left and right staple cases. The invention is characterized that, the left casing has a plurality of horizontal channels at an inner side thereof, with each channel placed with a pressing strip pushed by a small spring, such that the pressing strips are horizontally displaced using pushing forces from the springs; the left staple case is provided with a lower side rod at an inner side thereof; and the right staple case further has a staple-pushing board at an inner side thereof and being pushed by long springs, so that the long springs push the staple-pushing board to further push the staples. According to the aforesaid structure, staples having different depths are rested against an upper portion of the lower side rod. An upper portion of the staples is pressed against a lower portion of a specific pressing strip suitable for a depth of the staples, and specific pressing strips under a highermost position is pushed into the channels by the staples, thereby pressing against staples having various depths in a steady manner.

DETAILED DESCRIPTION OF THE PREFERRED EMBODIMENTS

To better understand the invention, detailed descriptions shall be given with the accompanying drawings below.

Figure 1:
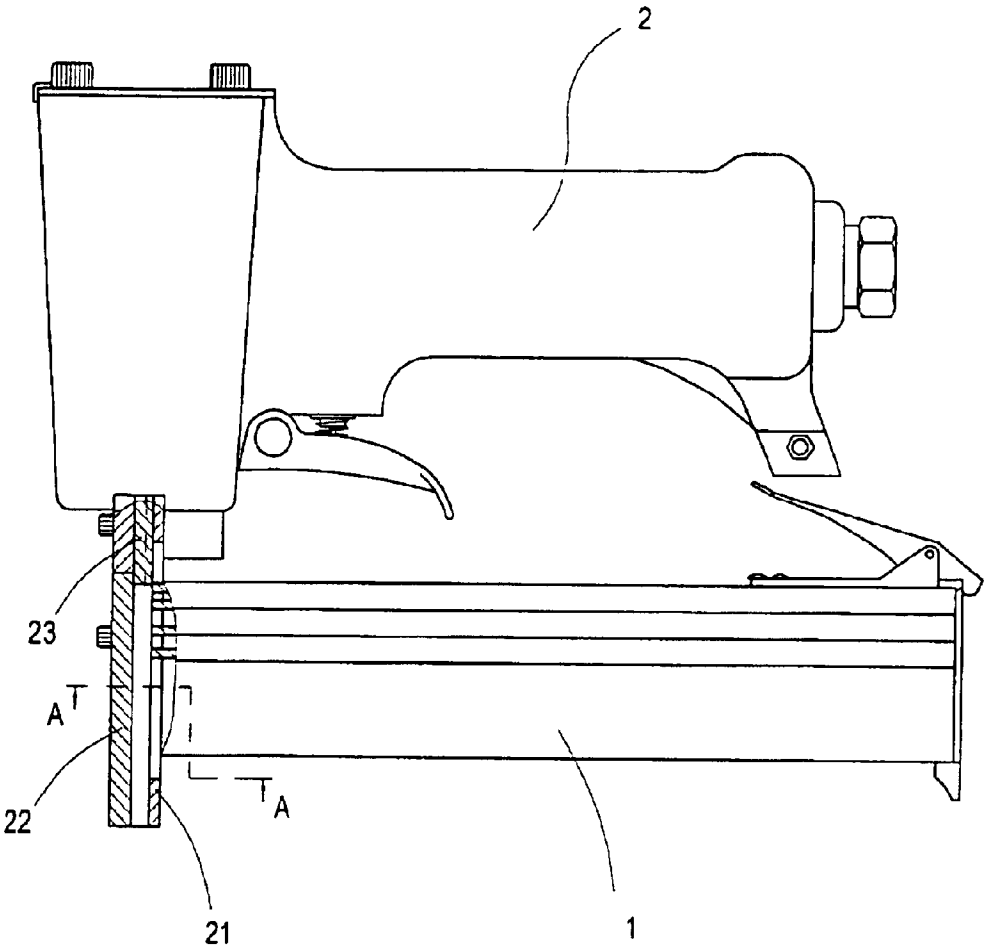
FIG. 1 shows an elevational view according to the invention.
Figure 2:
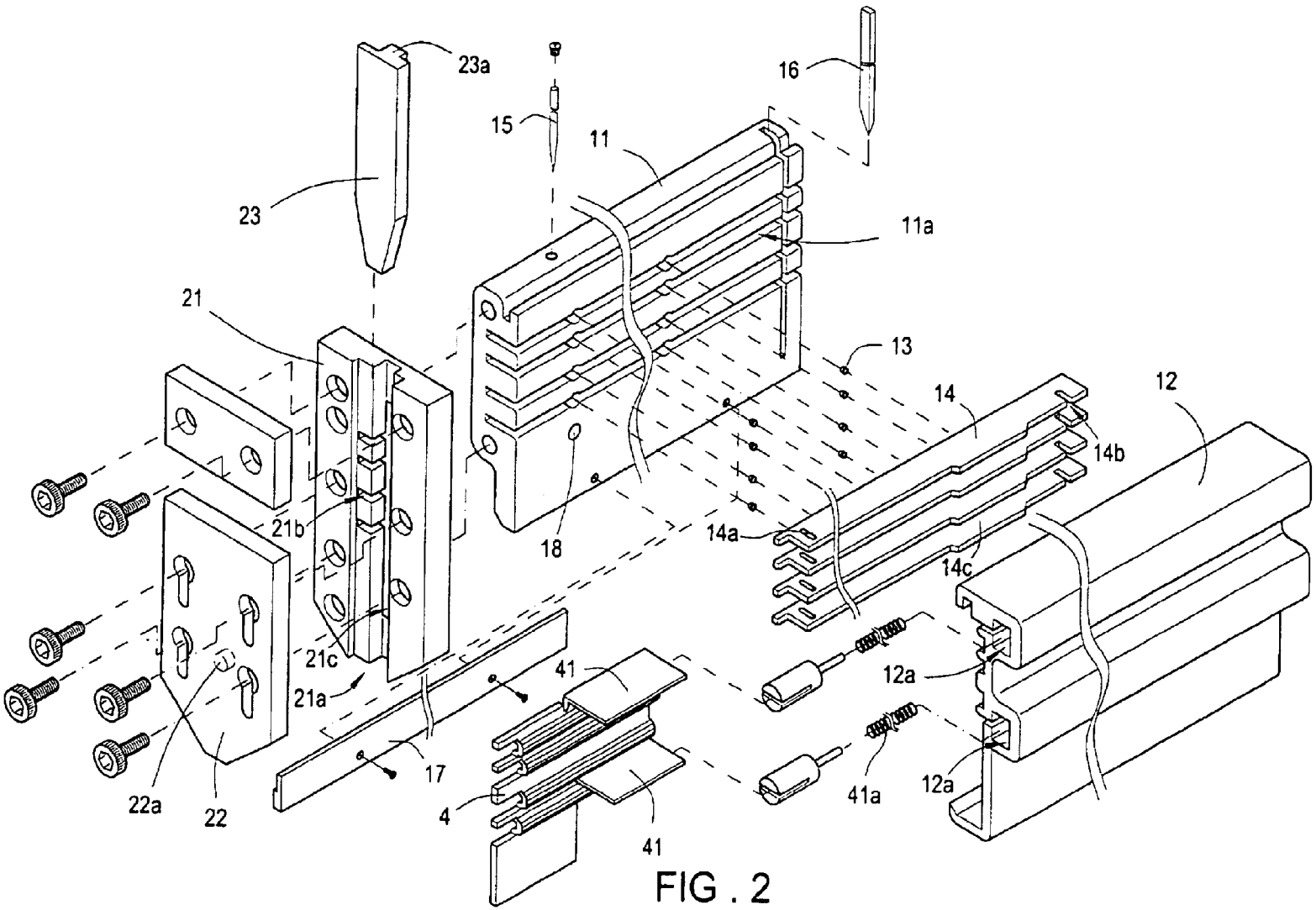
FIG. 2 shows an exploded elevational view of the staple case according to the invention.

Referring to FIGS. 1 and 2, a staple case 1 has a one end thereof disposed with a gun air-firing mechanism 2, and is consisted of a left staple case 11 and a right staple case 12.

The staple case 1 is placed with staples 3. The staple case 1 further has a front portion thereof provided with a guiding plate 21 and a cover plate 22, wherein the guiding plate 21 has a guiding groove 21*a*. A firing pin 23 of the gun air-firing mechanism 2 leans in the guiding groove 21*a* for sliding movements so as to fire the staples 3 one after another.

Figure 3:
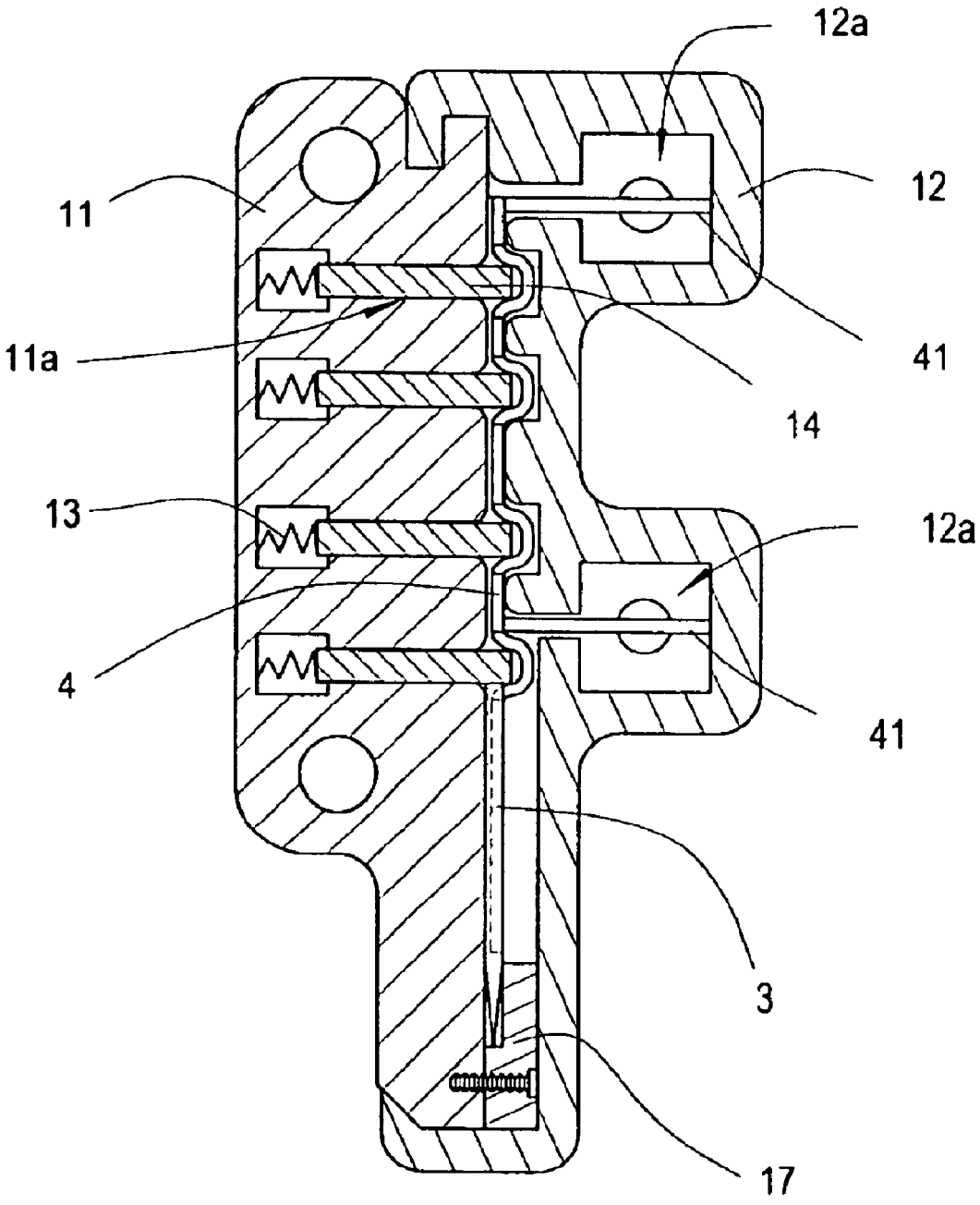
FIG. 3 shows a sectional view illustrating shortest staples being placed into the staple case according to the invention.
Figure 4:
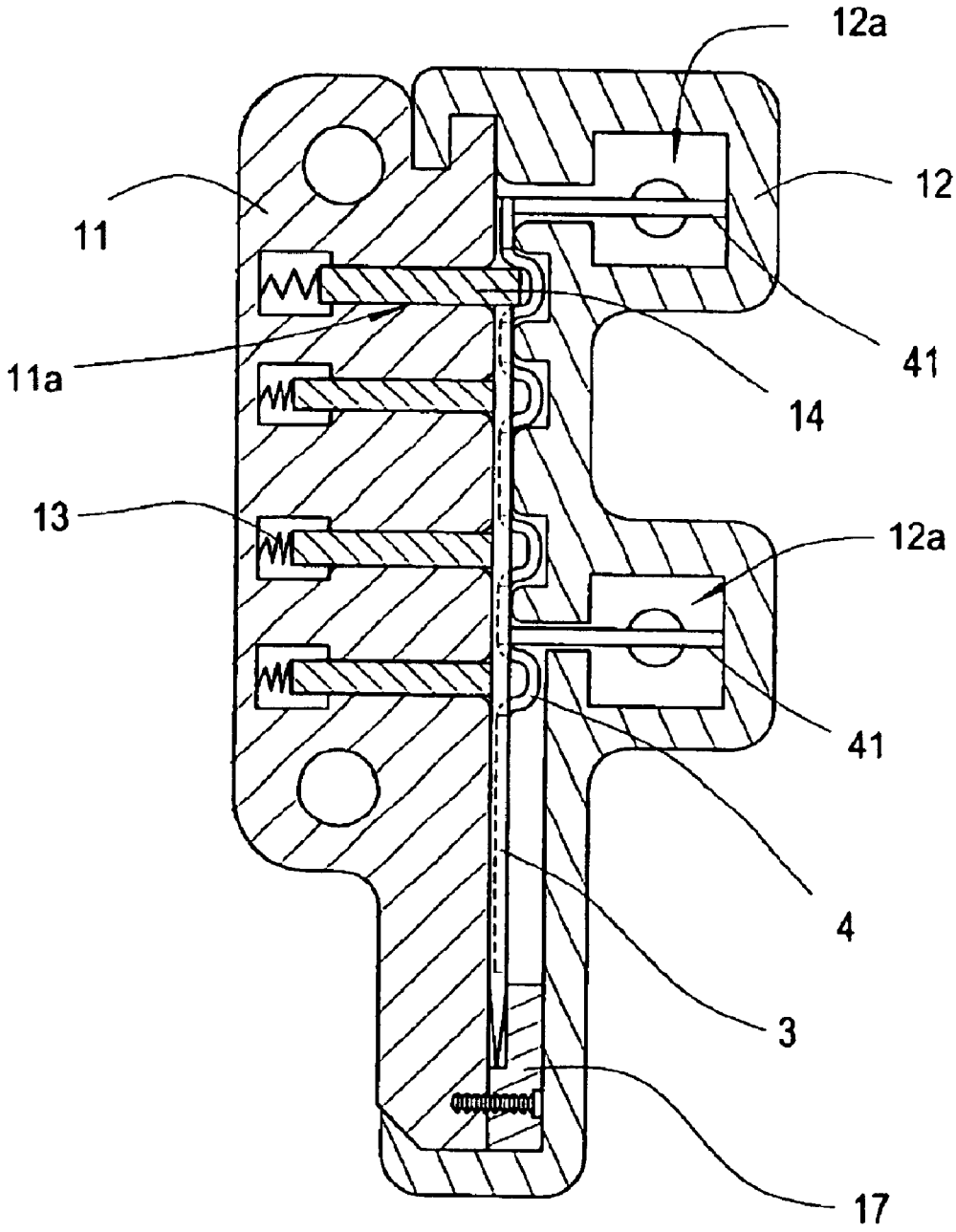
FIG. 4 shows a sectional view illustrating longest staples being placed into the staple case according to the invention.

The invention is characterized by the following descriptions. An interior of the left staple case 11 is provided with a plurality of horizontal channels 11*a*. Each of the channels 11*a* is placed with a pressing strip 14 pushed by a small spring 13. Each pressing strip 14 is disposed with a long opening 14*a* at one side thereof and an aperture 14*b* at the other side thereof. The left staple case 11 has a long pin 15 at one side thereof and vertically penetrated through the channels 11, and a pin bar 16 at the other side thereof and also vertically penetrated through the channels 11*a*, such that the long pin 15 is inserted through the long openings 14*a* of the pressing strips 14 and the pin bar 16 is leaned against the apertures 14*b* of the pressing strips 14. Thus, the pressing strips 14 are horizontally displaced due to pushing forces from the small springs 13. In addition, each pressing strip 14 has a protruding section 14*c* at a lower outer end thereof. The left staple case 11 further has a lower inner side thereof disposed with a lower side rod 17, so as to have staples 3 with different depths rest against an upper portion of the lower side rod 17. An upper portion of the staples 3 is leaned against a lower portion of a particular pressing strip 14 that is appropriate for a depth of the staples 3, and other pressing strips 14 located under the highermost position thereof are pushed into the channels 11*a* by the staples 3 as shown in FIGS. 3 and 4.

The right staple case 12 has at least two spring grooves 12*a* and a waveform staple-pushing board 4 at an inner side thereof. The staple-pushing board 4 is provided with projecting plates 41 corresponding to the spring grooves 12*a*. Each spring groove 12*a* is placed with a long spring 41*a* leaning against each projecting plate 41 of the staple-pushing board 4, so as to have the long springs 41*a* push against the staple-pushing board 4 to further push the staples 3. Moreover, when the right staple case 12 is pushed backward to fill in the staples 3, the staple-pushing board 4 is butted against the protruding sections 14*c* of the pressing strips 14, such that the pressing strips 14 are contracted inward to the channels 11*a* of the left staple case in order to fill in the staples 3.

According to the aforesaid structure, the right staple case 12 is first pushed backward, and the staples 3 are placed above the lower side rod 17 at the left staple case 3, with a top portion of the staples 3 pressing against a lower portion of a particular pressing strip 14 at the left staple case 11. The right staple 12 is then pushed forward, and the staple-pushing board 4 at the inner side of the right staple-case 12 also pushes the staples 3 forward, thereby disengaging and firing the staples 3 at a front end one after another using the firing pin 23 of the gun air-firing mechanism 2.

The pressing strips 14 located in the channels 11*a* of the left staple case 11 are capable of horizontally projecting out of the channels 11*a*. Therefore, when staples 3 having different depths are placed, when the staples 3 having a specific depth are located above the lower pressing strip 14, the pressing strip 14 at a lower position is utilized for pressing the staples 3 as shown in FIG. 3. When the staples 3 having a specific depth are located above the lowermost pressing strip 14, the lowermost pressing strip 14 is pushed into the channel 11*a* of the left staple case 11 by the staples 3. A top portion of the staples 3 is pressed against a lower portion of a previous pressing strip 14, and deepest staples 3 are pressed against an uppermost pressing strip 14 of the left staple case 11 as shown in FIG. 4. Therefore, staples 3 having different depths are steadily pressed by the pressing strips 14 located at different heights.

In addition, the pressing strips 14 at the inner side of the left staple case 11 are individually pushed in a horizontally outward direction by the small springs 13, and the pressing strips 14 press against staples 3 with corresponding depths. Therefore, regardless of depths of the staples 3, a rear end of the staples 3 is pushed by the staple-pushing board 4 at the inner side of the right staple case 12 with evenly distributed pushing forces, thereby eliminating complications of prior inventions with uneven pushing forces and providing better practicability.

When the right staple case 12 is pushed backward for filling in the staples 3, the staple-pushing board 4 is pressed against the protruding sections 14*c* of the pressing strips, such that the pressing strips 14 are individually contracted into the channels 11*a* of the left staple case 11 to facilitate filling in the staples 3. When the right staple case 12 is pushed forward, the staple-pushing board 4 becomes no longer pressed against the protruding sections 14*c* of the pressing strips 14 at the left staple case 11. The pressing strips 14 are then individually slid outward using the small springs 13 in the channels 11*a* of the left staple case 11, and are pressed against the staples 3 according to a depth of the staples 3 as described above.

Figure 5:
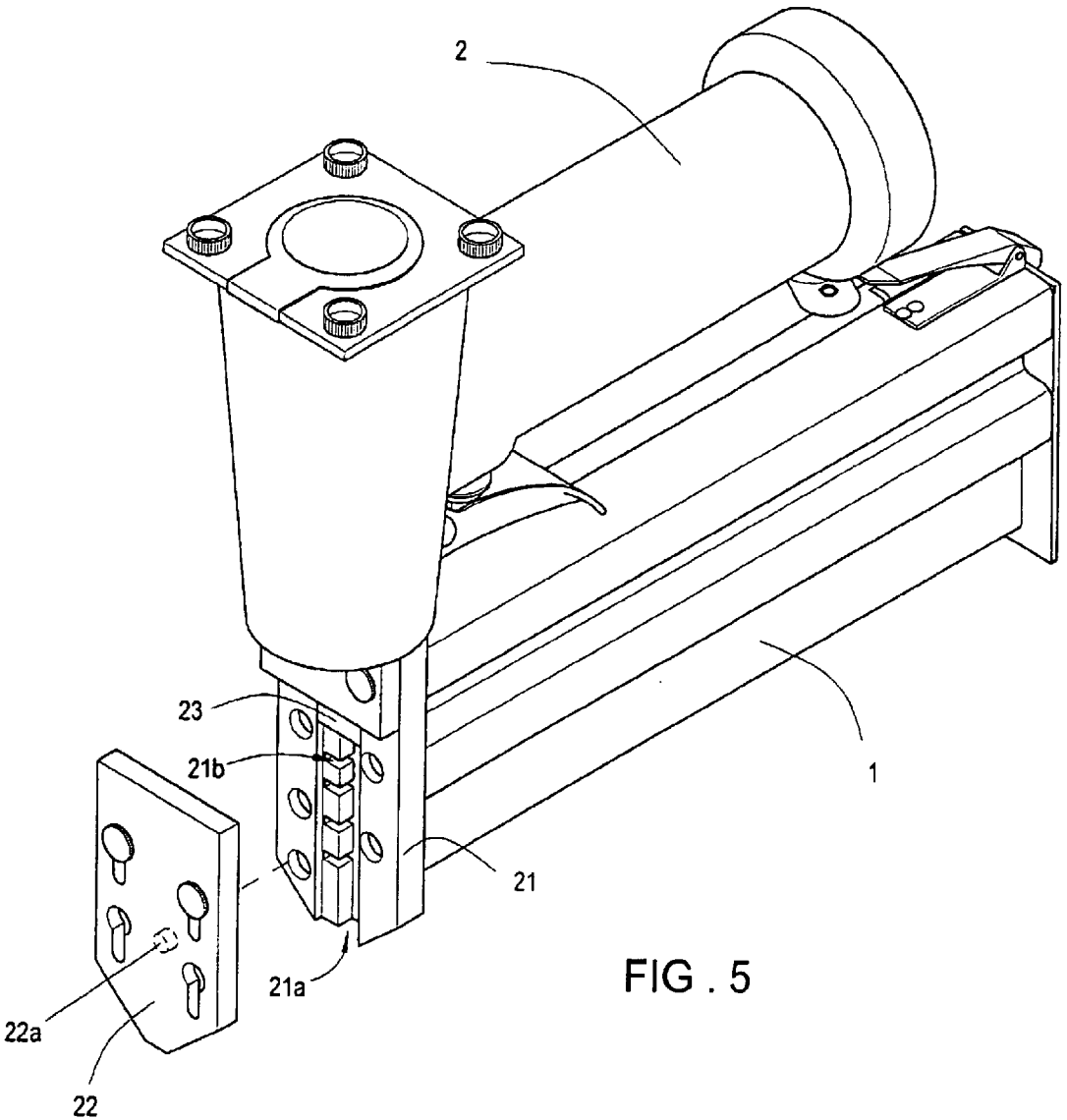
FIG. 5 shows an elevational view of another embodiment according to the invention.
Figure 6:
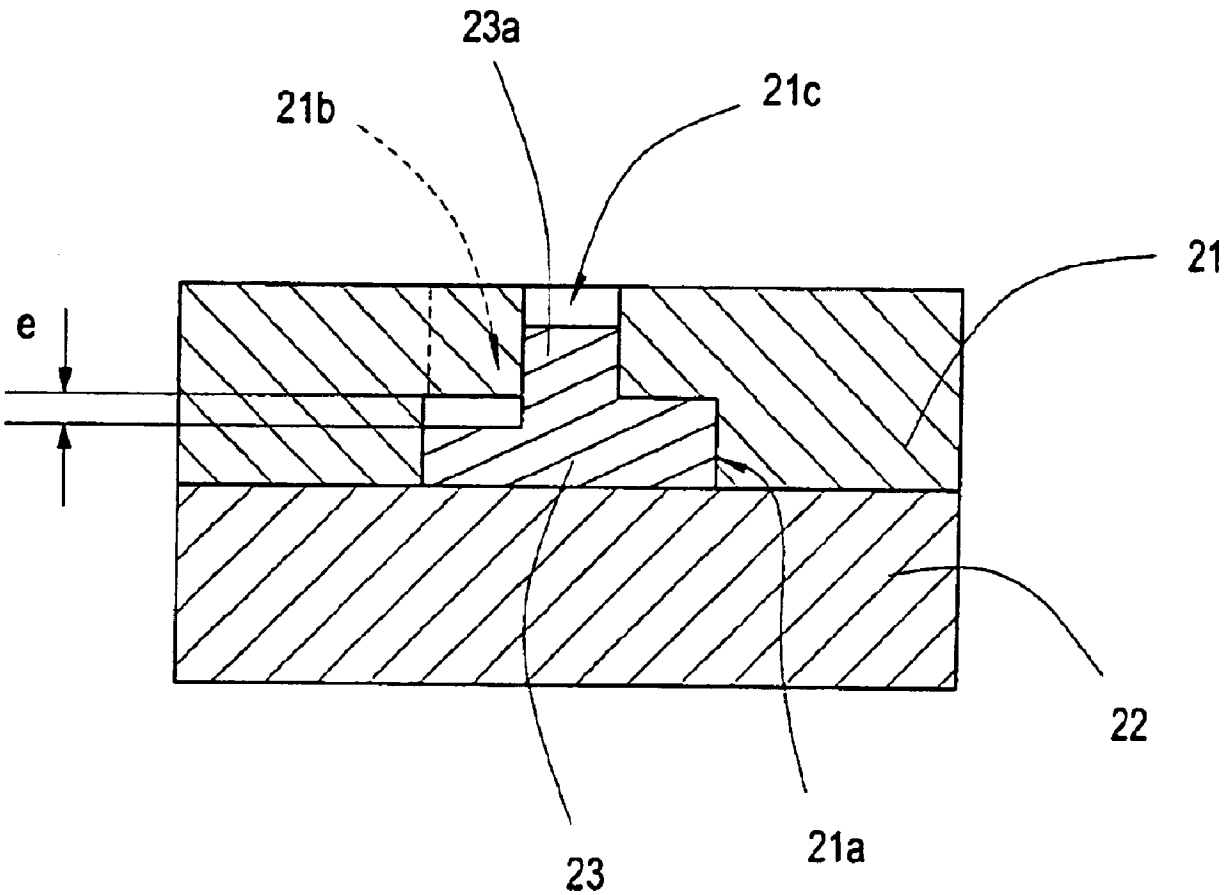
FIG. 6 shows a sectional view of FIG. 1 taken along A—A.

Referring to FIG. 5, the guiding plate 21 is provided with an indentation 21*b* for corresponding with the left staple case 11, with the end portions of the strips 14 being rested in the indentation 21*b*. A center portion of the guiding plate 21 further has staple tracks 21*c* for pushing the staples 3 outward. The firing pin 23 has a sectional plane leaning against the indentation 21*b* of the guiding plate 21 disposed with a gap 3 as shown in FIG. 6. The other side of the sectional plane of the firing pin 23 is pressed against the guiding groove 21*a* of the guiding plate 21 for sliding movements. The firing pin 23 also has a protruding section 23*a* at a center portion thereof, and the protruding section 23*a* is butted into the staple tracks 23*c* of the firing pin 23 in order to butt the staples 3 outward. For that the sectional plane of the firing pin 23 is provided with three different depths, enhanced structural strength is thus obtained. The aforesaid description illustrates another embodiment for reference.

Referring to FIG. 2 showing another embodiment according to the invention, an inner front portion of the left staple case 11 is disposed with a magnet 18. Using the magnet 18 attracting the staples 3, the staples 3 are stabilized through magnetism of the magnet 18, so as to facilitate the aforementioned staple-pushing board 4 to push the staples 3 inward.

An inner side of the cover plate 22 at a front end of the staple case 1 is disposed with another magnet 22*a*. In another embodiment according to the invention, magnetism of the magnet 22*a* is adopted for similarly stabilizing the staples 3.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A positioning staple case of a stacker, comprising a gun air-firing mechanism at one end thereof; wherein, the staple case is consisted of a left staple case and a right staple case, placed with staples at an interior thereof, and disposed with a guiding plate and a cover plate at a front portion thereof; the guiding plate has a guiding groove; a firing pin of the gun air-firing mechanism is rested in the guiding groove to fire the staples outward one after another; and the characteristics being that, the left casing has a plurality of horizontal channels at an inner side thereof, with each channel placed with a pressing strip pushed by a small spring; each pressing strip has a long opening at one side thereof and an aperture at the other side thereof; the left staple case has a long pin at one side thereof and vertically penetrated through the channels, and a pin bar at the other side thereof and also vertically penetrated through the channels, such that the long pin is inserted through the long openings of the pressing strips, the pin bar is leaned against the apertures of the pressing strips, and the pressing strips are horizontally displaced using pushing forces from the springs; each pressing strip further has a protruding section at a lower outer end thereof; the left staple case also has a lower inner side thereof disposed with a lower side rod, so that the staples with different depths are rested against an upper portion of the lower side rod; and upper portion of the staples is leaned against a lower portion of a particular pressing strip that is appropriate for a depth of the staples, and particular pressing strips located above the lowermost pressing strips are pushed into the channels by the staples;

the right staple case has at least two spring grooves and a waveform staple-pushing board at an inner side thereof; the staple-pushing board is provided with projecting plates corresponding to the spring grooves; each spring groove is placed with a long spring leaning against each projecting plate of the staple-pushing board, thereby having the long springs push against the staple-pushing board to further push the staples; and when the right staple case is pushed back to fill in the staples, the staple-pushing board is pressed against the protruding sections of the pressing strips, thereby contracting the pressing strips inward to the channels of the left staple case in order to facilitate filling in the staples.

2. The positioning staple case of a stacker in accordance with claim 1, wherein the cover plate has an upper cover plate and a lower cover plate.

3. The positioning staple case of a stacker in accordance with claim 1, wherein the guiding plate has an indentation corresponding with the left staple case, such that end portions of the pressing strips are rested in the indentation; a center portion of the guiding plate is provided with staple tracks for pushing the staples outward; the firing pin has a sectional plane pressed against the indentation of the guiding plate provided with a gap, and the other sectional plane thereof leaning against the guiding groove for sliding movements; a center portion of the firing pin is disposed with a protruding section butted in the staple tracks at the center portion of the guiding plate to further butt the staples outward.

4. The positioning staple case of a stacker in accordance with claim 1, wherein an inner front portion of the left staple case is disposed with a magnet, thereby stabilizing the staples by attracting the staples using the magnet.

5. The positioning staple case of a stacker in accordance with claim 1, wherein an inner side of the cover plate at a front end of the staple is disposed with a magnet, thereby stabilizing the staples using magnetism of the magnet.

* * * * *